US007018168B2

(12) United States Patent
Worthoff et al.

(10) Patent No.: US 7,018,168 B2
(45) Date of Patent: Mar. 28, 2006

(54) METHOD AND APPARATUS FOR FABRICATING GAS TURBINE ENGINES

(75) Inventors: Frank Worthoff, West Chester, OH (US); Christopher Charles Glynn, Hamilton, OH (US); David William Crall, Loveland, OH (US); David Lawrence Bedel, Batesville, IN (US)

(73) Assignee: General Electric Company, Schenectady, NY (US)

( * ) Notice: Subject to any disclaimer, the term of this patent is extended or adjusted under 35 U.S.C. 154(b) by 36 days.

(21) Appl. No.: 10/820,491

(22) Filed: Apr. 8, 2004

(65) Prior Publication Data

US 2005/0226714 A1 Oct. 13, 2005

(51) Int. Cl.
*F01D 21/00* (2006.01)

(52) U.S. Cl. ..... 415/9

(58) Field of Classification Search ..... 415/9, 415/173.4, 174.4, 200

See application file for complete search history.

(56) References Cited

U.S. PATENT DOCUMENTS 4,149,824 A 4/1979 Adamson
4,534,698 A 8/1985 Tomich
4,699,567 A * 10/1987 Stewart ..... 415/9
5,188,505 A 2/1993 Schilling et al.
5,336,044 A 8/1994 Forrester
5,403,148 A 4/1995 Forrester
5,431,532 A 7/1995 Humke et al.
5,437,538 A * 8/1995 Mitchell ..... 415/9
5,486,086 A 1/1996 Bellia et al.

FOREIGN PATENT DOCUMENTS

GB 2037900 A * 7/1980 ..... 415/9

* cited by examiner

*Primary Examiner*—Christopher Verdier
(74) *Attorney, Agent, or Firm*—William Scott Andes; Armstrong Teasdale LLP

(57) ABSTRACT

A method facilitates fabricating a gas turbine engine. The method comprises coupling an engine casing circumferentially around a gas turbine engine. The method also comprises coupling an engine containment wrap to the gas turbine engine, such that the containment wrap circumscribes at least a portion of the gas turbine engine casing, wherein the containment wrap includes a plurality of layers coupled together such that a first layer is formed from at least three sheets coupled together such that the first sheet fibers are oriented substantially in a first direction, such that the second sheet fibers are oriented in a second direction that is offset approximately forty-five degrees from the first sheet, and such that the third sheet fibers are oriented substantially parallel to the first direction, and wherein the plurality of first sheet fibers are aligned substantially axially with the respect to the turbine engine.

16 Claims, 5 Drawing Sheets

METHOD AND APPARATUS FOR FABRICATING GAS TURBINE ENGINES

BACKGROUND OF THE INVENTION

This invention relates generally to gas turbine engines, and more particularly, to methods and apparatus for operating gas turbine engines.

At least some known gas turbine engines typically include high and low pressure compressors, a combustor, and at least one turbine. The compressors compress air which is mixed with fuel and channeled to the combustor. The mixture is then ignited for generating hot combustion gases, and the combustion gases are channeled to the turbine which extracts energy from the combustion gases for powering the compressor, as well as producing useful work to propel an aircraft in flight or to power a load, such as an electrical generator.

During engine operation, foreign objects may be unavoidably ingested into the engine. More specifically, various types of foreign objects, such as birds, hailstones, sand and/or rain may become entrained in the inlet of a gas turbine engine. As the foreign objects are forced through the engine, the objects may impact a blade resulting in a portion of the impacted blade being torn loose from a rotor. Such a condition, known as foreign object damage (FOD), may cause the rotor blade to contact and/or pierce an engine casing resulting in cracks along an exterior surface of the engine casing, causing possible injury to nearby personnel, and/or damage to adjacent equipment. Over time, the foreign object damage may cause a portion of the engine to bulge or deflect causing additional stresses to be induced along the entire engine casing.

To facilitate preventing such casing stresses, and to minimize the risks of injuries to personnel, at least some known engines include a metallic casing shell that facilitates increasing a radial and an axial stiffness of the engine, and to facilitate reducing stresses near any engine casing penetration. However, because such casing shells increase the overall weight of the engine, such shells may also adversely impact the engine performance.

BRIEF SUMMARY OF THE INVENTION

In one aspect, a method for fabricating a gas turbine engine is provided. The method comprises coupling an engine casing circumferentially around a gas turbine engine. The method also comprises coupling an engine containment wrap to the gas turbine engine, such that the containment wrap circumscribes at least a portion of the gas turbine engine casing, wherein the containment wrap includes a plurality of layers coupled together such that a first layer is formed from at least three sheets coupled together such that a first sheet is formed from a plurality of fibers that are oriented substantially in a first direction, a second sheet is formed from a plurality of fibers oriented in a second direction that is offset approximately forty-five degrees from the first sheet, and such that a third sheet is formed from a plurality of fibers that are oriented substantially parallel to the first direction, and wherein the plurality of first sheet fibers are aligned substantially axially with the respect to the gas turbine engine.

In another aspect, a containment apparatus for a gas turbine engine including an engine casing is provided. The containment apparatus includes a first layer including a plurality of sheets that each includes a plurality of fibers. A first of the plurality of sheets is coupled to the gas turbine engine casing such that the first sheet circumscribes at least a portion of the casing and such that the first sheet plurality of fibers are aligned substantially axially with respect to the gas turbine engine. A second of the plurality of sheets is coupled to the first sheet such that the second sheet plurality of fibers are aligned approximately forty-five degrees offset from the first sheet plurality of fibers. A third of the plurality of sheets is coupled to the second sheet such that the third sheet plurality of fibers are aligned substantially parallel to the first sheet plurality of fibers.

DETAILED DESCRIPTION OF THE INVENTION

Figure 1:
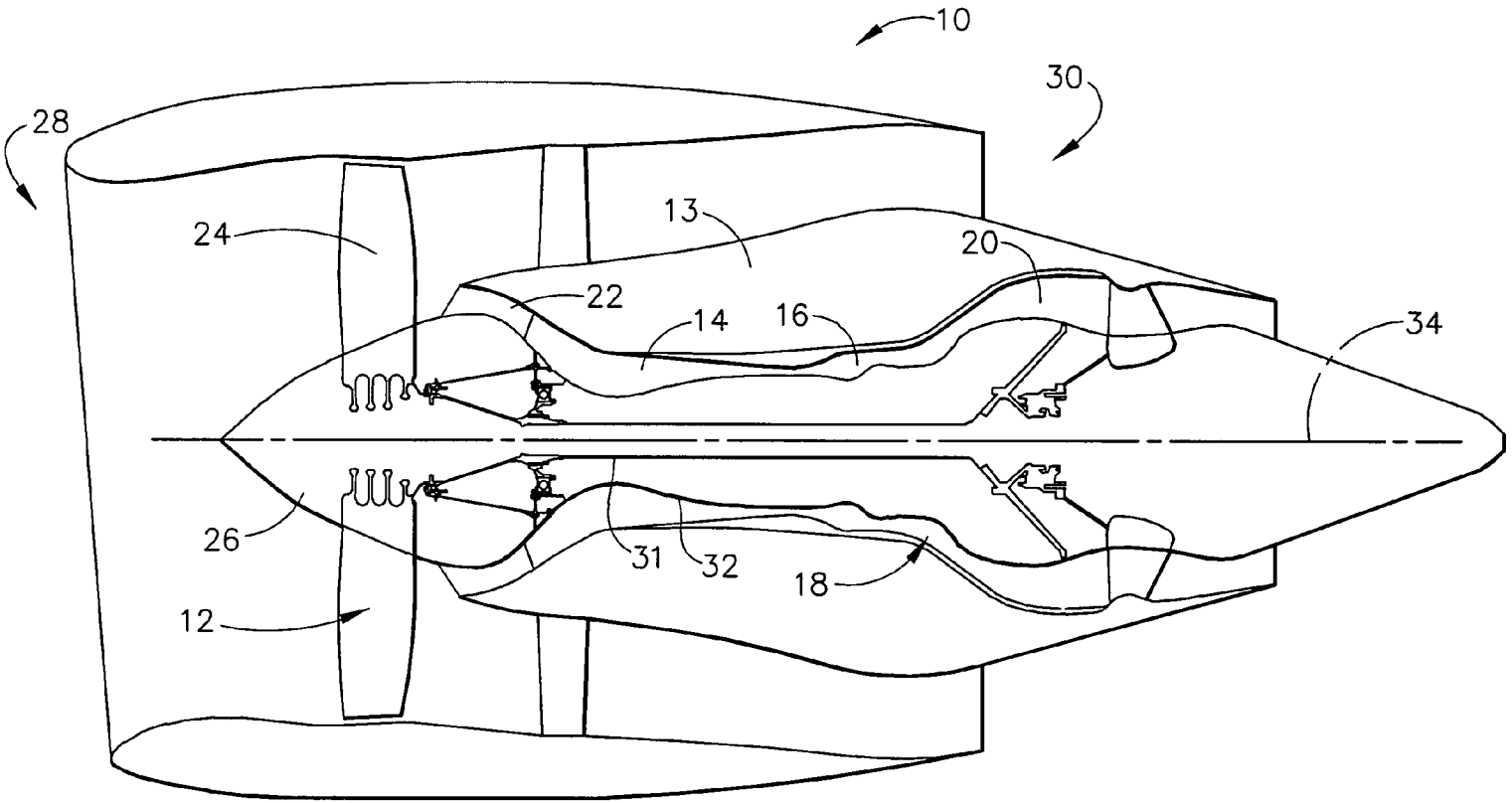
FIG. 1 is schematic illustration of an exemplary gas turbine engine.

FIG. 1 is a schematic illustration of a gas turbine engine 10 including a fan assembly 12 and a core engine 13 including a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, the gas turbine engine is a GE90 available from General Electric Company, Cincinnati, Ohio. Fan assembly 12 and turbine 20 are coupled by a first rotor shaft 31, and compressor 14 and turbine 18 are coupled by a second rotor shaft 32.

During operation, air flows through fan assembly 12, in a direction that is substantially parallel to a central axis 34 extending through engine 10, and compressed air is supplied to high pressure compressor 14. The highly compressed air is delivered to combustor 16. Airflow (not shown in FIG. 1) from combustor 16 drives turbines 18 and 20, and turbine 20 drives fan assembly 12 by way of shaft 31.

Figure 2:
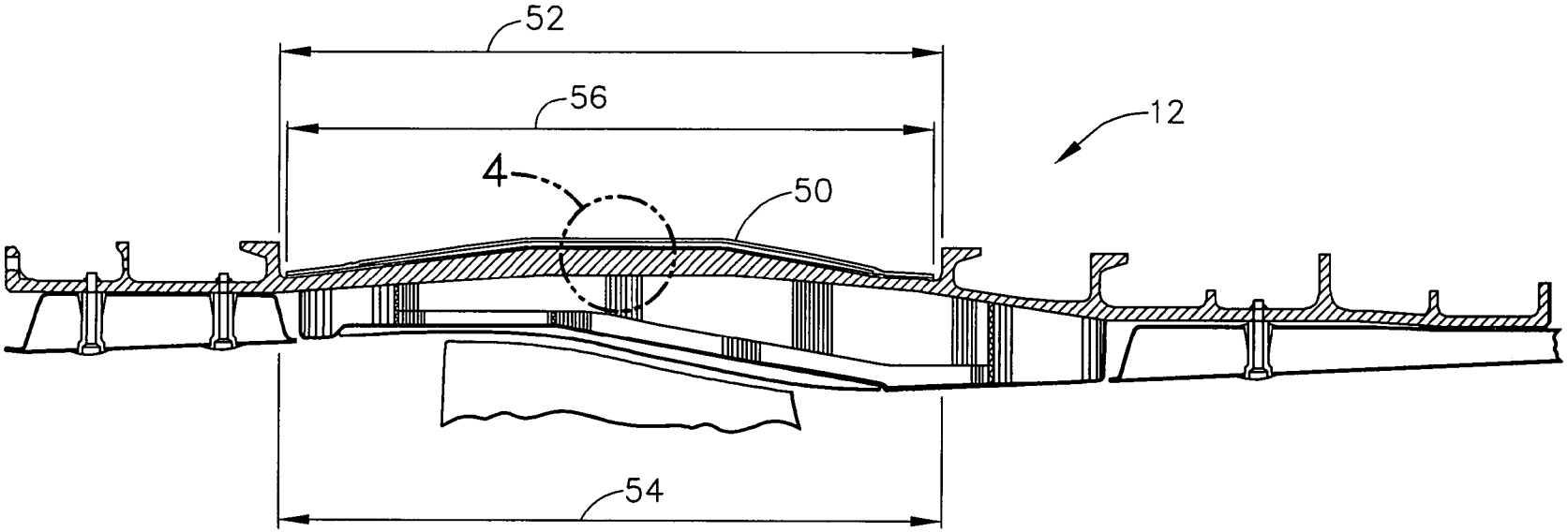
FIG. 2 is a cross-sectional view of a blade containment apparatus that may be used with the gas turbine engine shown in FIG. 1.

FIG. 2 is a cross-sectional view of a portion of fan assembly 12, and an exemplary engine hybrid containment system 50. In the exemplary embodiment, engine containment system 50 is a hybrid, hardwall containment system that has a length 52 is that is approximately equal to a length 54 of a portion of fan assembly 12. More specifically, length 52 is variably selected to enable engine containment system 50 to substantially circumscribe a prime containment zone 56 extending around fan assembly 12. Prime containment zone 56, as used herein, is defined as a zone that extends both axially and circumferentially around fan assembly 12 and represents an area wherein a fan blade (not shown) is most likely to be radially flung or ejected from fan assembly 12.

Figure 3:
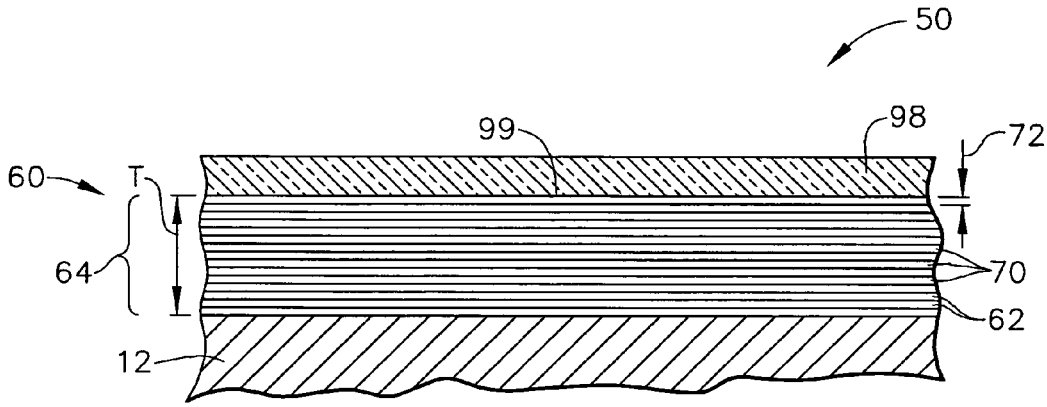
FIG. 3 is a cross-sectional view of a portion of the blade containment apparatus shown in FIG. 2.
Figure 4:
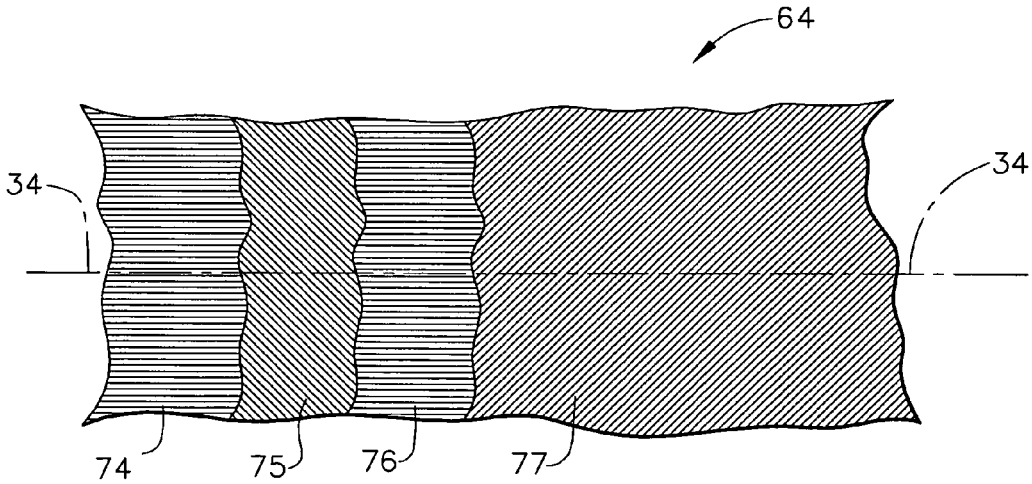
FIG. 4 is a roll-out schematic view of the portion of the blade containment apparatus shown in FIG. 3 and taken along area 4 (shown in FIG. 2)

FIG. 3 is a cross-sectional view of a portion of exemplary engine containment system 50. FIG. 4 is a roll-out schematic view of a portion of system 50 and taken along area 4. In the exemplary embodiment, engine containment system 50 includes at least one layer 60 formed to extend at least partially circumferentially around fan assembly 12. As used herein, "formed" includes processes used in fabricating each engine containment system 50, including, but not limited to, patterning and laminating. Each containment layer 60 includes a plurality of sheets 62 that are fabricated from a uni-directional material. As used herein, a uni-directional material is defined as a material that includes a plurality of thin, relatively flexible, and long fibers which have a high tensile strength, such as, but not limited to fiberglass materials.

In the exemplary embodiment, engine containment system 50 includes at least one layer 64. Layer 64 includes a plurality of sheets 70 that are fabricated from a unidirectional material. In the exemplary embodiment, sheets 70 are fabricated from a fiberglass material. In the exemplary embodiment, each sheet 70 has a thickness 72 that is approximately equal throughout layer 64. In one embodiment, each sheet 70 is between approximately 0.008 and 0.010 inches thick. In another embodiment, each sheet 70 is between approximately 0.005 and 0.015 inches thick. In one embodiment, each sheet 70 is approximately 0.009 inches thick. In the exemplary embodiment, first layer 64 includes approximately fifteen sheets 70 coupled together using a bonding agent, such as epoxy. Accordingly, in the exemplary embodiment, first layer 64 is approximately 0.015 inches thick.

During fabrication, first layer 64 is formed on fan assembly 12 such that first layer 64 at least partially circumscribes an outer periphery of fan assembly 12. More specifically, a first sheet 74 is attached to fan assembly 12 such that the plurality of fibers within first sheet 74 are oriented substantially axially with respect to center axis 34. A second sheet 75 is bonded to first sheet 74 such that the plurality of fibers within sheet 74 are offset from the fibers within first sheet 74 by approximately 45°. A third sheet 76 is then bonded to second sheet 75 such that the plurality of fibers within third sheet 76 are aligned substantially axially with respect to engine 10, and a fourth sheet 77 is bonded against third sheet 76 such that the plurality of fibers within sheet 77 are substantially perpendicular to each other and are offset from the plurality of fibers within third sheet 76 by approximately −45°. Accordingly, fibers within first sheet 74 and third sheet 76 are each aligned substantially axially, and fibers within second sheet 75 and fourth sheet 77 are offset approximately 45° from the axial direction.

The fabrication process is repeated continuing the alternating pattern of adjacent sheets 70 until first layer 64 has reached a desired overall thickness T. A protective layer 98 is then bonded to an exterior surface 99 of layer 64. In the exemplary embodiment, protective layer 98 is fabricated from a material such, as but not limited to, a glass material.

When fabrication of engine containment system 50 is completed, containment system 50 facilitates axially and circumferentially reducing cracks which may develop when a rotor blade penetrates engine casing within prime containment zone 56. More specifically, the orientation of the fibers within first layer 64 facilitates increasing an axial stiffness of the engine casing, such that the expansion of thickness cracks which may develop is facilitated to be reduced circumferentially around an outer periphery of the engine casing. More specifically, the first layer fibers facilitate redistributing a stress load induced along the outer periphery of the engine casing.

Figure 5:
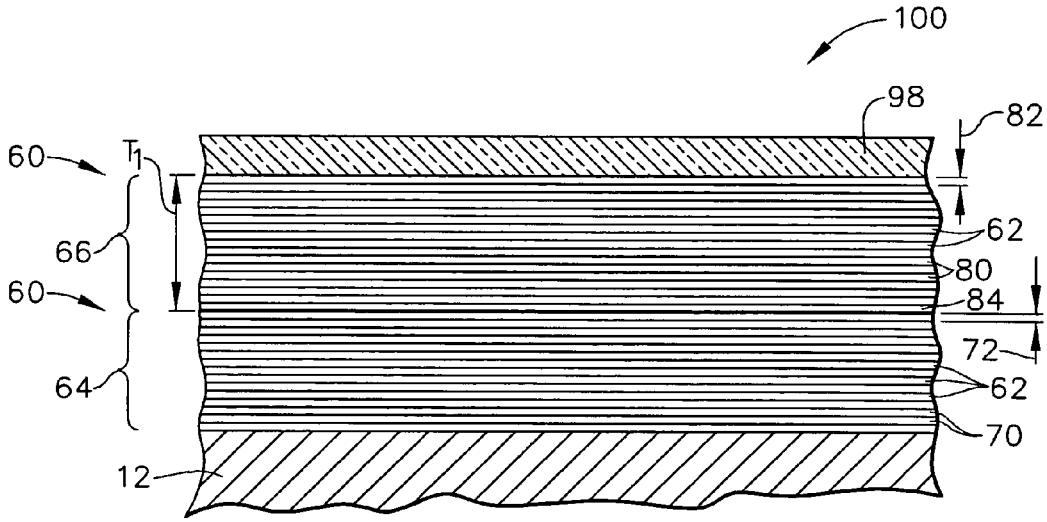
FIG. 5 is a cross-sectional view of a portion of an alternative embodiment of a blade containment apparatus that may be used with the engine shown in FIG. 1.
Figure 6:
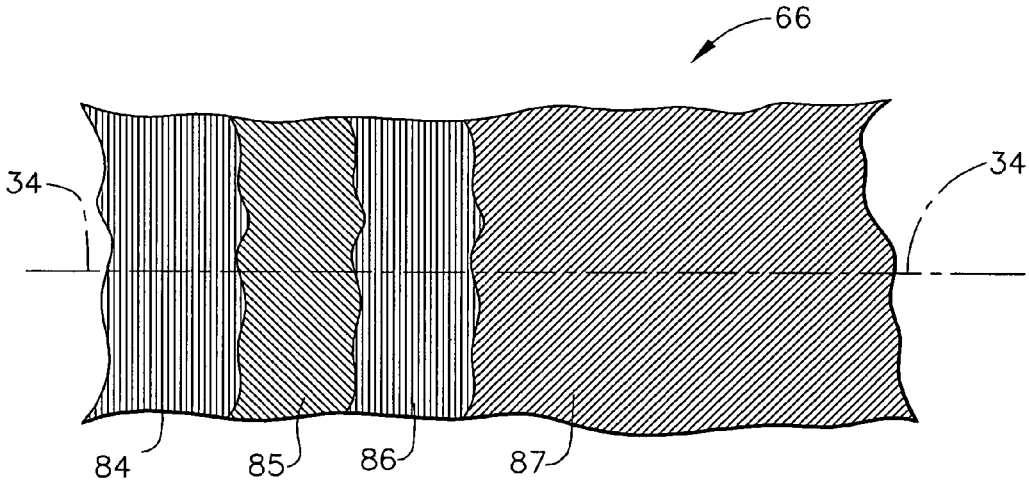
FIG. 6 is a roll-out schematic view of a portion of the blade containment apparatus shown in FIG. 5.

FIG. 5 is a cross-sectional view of a portion of an alternative embodiment of a blade containment apparatus 100 that may be used with engine 10 (shown in FIG. 1). FIG. 6 is a roll-out schematic view of the portion of blade containment apparatus 100. Containment 100 is substantially similar to containment 50 (shown in FIGS. 3 and 4) and components in containment 100 that are identical to components of containment 50 are identified in FIGS. 5 and 6 using the same reference numerals used in FIGS. 3 and 4. More specifically, in the exemplary embodiment, engine containment apparatus 100 includes first layer 64 and a second layer 66 bonded to first layer 64.

Second layer 66 includes a plurality of sheets 80 that are fabricated from a unidirectional material. In the exemplary embodiment, sheets 80 are fabricated from a graphite material. In the exemplary embodiment, each sheet 80 has a thickness 82 that is approximately equal throughout layer 66. In one embodiment, each sheet 80 is between approximately 0.004 and 0.006 inches thick. In another embodiment, each sheet 80 is between approximately 0.002 and 0.008 inches thick. In one embodiment, each sheet 80 is approximately 0.005 inches thick. In the exemplary embodiment, second layer 66 includes approximately seventeen sheets 80 coupled together using a bonding agent, such as epoxy. Accordingly, in the exemplary embodiment, second layer 66 is approximately 0.085 inches thick.

During fabrication, second layer 66 is formed on first layer 64 such that second layer 66 at least partially circumscribes a portion of an outer periphery of first layer 64. More specifically, a first sheet 84 is attached to first layer 64 such that the plurality of fibers within first sheet 84 are oriented substantially perpendicular to center axis. A second sheet 85 is bonded to first sheet 84 such that the plurality of fibers within sheet 85 are offset from the fibers within sheet 85 by 45°. A third sheet 86 is then bonded to second sheet 85 such that the plurality of fibers within sheet 86 are aligned substantially perpendicularly to center axis 34, and a fourth sheet 87 is bonded against third sheet 86 such that the plurality of fibers within sheet 87 are offset from the plurality of fibers within sheet 86 by approximately −45°. Accordingly, fibers within first sheet 84 and third sheet 86 are aligned substantially parallel to each other and substantially perpendicular to center axis 34, and fibers within second sheet 85 and fourth sheet 87 are substantially perpendicular to each other and offset from center axis 34 by approximately 45°.

The fabrication process is repeated such that the alternating pattern of adjacent sheets 80 is continued until second layer 66 has reached a desired thickness $T_1$. Protective layer 98 is then bonded to an exterior surface 99 of layer 64. In the exemplary embodiment, protective layer 98 is fabricated from a material such, as but not limited to, a glass material.

When fabrication of engine containment system 100 is completed, containment system 100 facilitates axially and circumferentially reducing cracks which may develop when a rotor blade penetrates engine casing within prime containment zone 56. More specifically, the orientation of the fibers within first layer 64 facilitates increasing an axial stiffness of the engine casing, such that the expansion of thickness cracks which may develop is facilitated to be reduced circumferentially around an outer periphery of the engine casing. More specifically, the first layer fibers facilitate redistributing a stress load induced along the outer periphery of the engine casing.

Moreover, the combination of the graphite material within second layer 66 and the relative orientation of the fibers within the sheets 80 forming layer 66 facilitate increasing radial or hoop stiffness to the engine casing. Accordingly, layer 66 facilitates reducing a field stress induced to the engine casing during a blade impact event.

Figure 7:
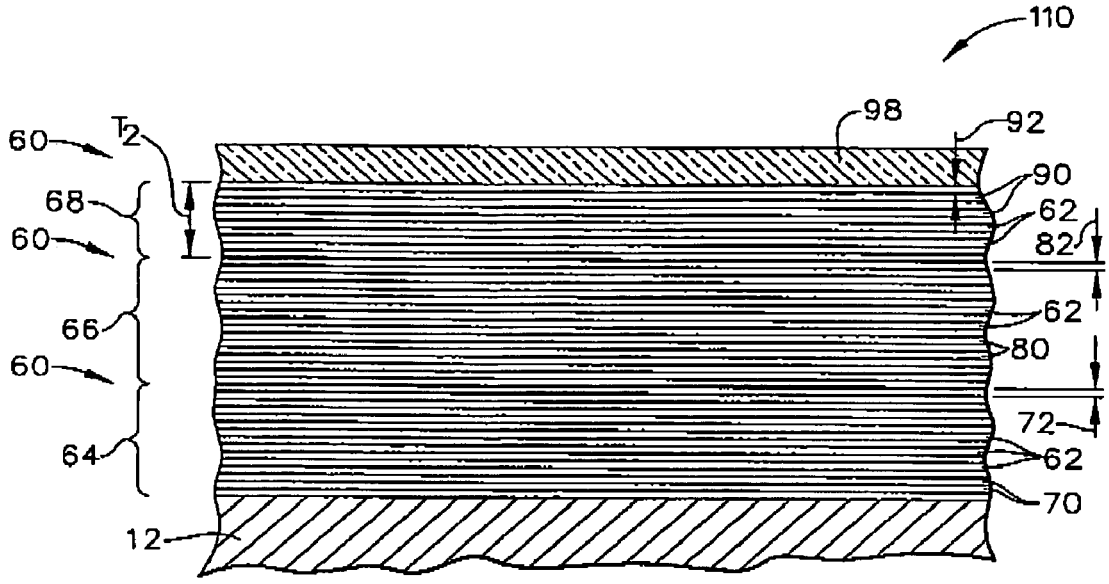
FIG. 7 is a cross-sectional view of a portion of an alternative embodiment of a blade containment apparatus that may be used with the engine shown in FIG. 1.

FIG. 7 is a cross-sectional view of a portion of an alternative embodiment of a blade containment apparatus 110 that may be used with engine 10 (shown in FIG. 1). Containment 110 is substantially similar to containments 50 and 100 (shown in FIGS. 3–6) and components in containment 110 that are identical to components of containments 50 and 100 are identified in FIG. 7 using the same reference numerals used in FIGS. 3–6. More specifically, in the exemplary embodiment, engine containment apparatus 110 includes first layer 64 second layer 66, and a third layer 68.

Third layer 68 includes a plurality of sheets 90 that are fabricated from a uni-directional material. In the exemplary embodiment, sheets 90 are fabricated from a glass-epoxy material. In the exemplary embodiment, each sheet 90 has a thickness 92 that is approximately equal throughout layer 68. In one embodiment, each sheet 90 is between approximately 0.008 and 0.010 inches thick. In another embodiment, each sheet 90 is between approximately 0.005 and 0.015 inches thick. In one embodiment, each sheet 90 is approximately 0.009 inches thick. In the exemplary embodiment, third layer 68 includes approximately ten sheets 90 coupled together using a bonding agent, such as epoxy. Accordingly, in the exemplary embodiment, third layer 68 is at least approximately 0.090 inches thick.

When fabrication of engine containment system 110 is completed, containment system 110 facilitates axially and circumferentially reducing cracks which may develop when a rotor blade penetrates engine casing within prime containment zone 56. More specifically, the orientation of the fibers within first layer 64 facilitates increasing an axial stiffness of the engine casing, such that the expansion of thickness cracks which may develop is facilitated to be reduced circumferentially around an outer periphery of the engine casing. More specifically, the first layer fibers facilitate redistributing a stress load induced along the outer periphery of the engine casing.

Moreover, the combination of the graphite material within second layer 66 and the relative orientation of the fibers within the sheets 80 forming layer 66 facilitate increasing radial or hoop stiffness to the engine casing. Accordingly, layer 66 facilitates reducing a field stress induced to the engine casing during a blade impact event. In addition, because third layer 68 is fabricated from a glass epoxy material, layer 68 facilitates increasing a torsional and axial stiffness of the engine case, and therefore facilitates reducing relatively large circumferential cracks in the engine casing which may occur after the blade impact event and while the turbine is wind-milling.

The above-described engine containment system is cost-effective and highly reliable in facilitating in reducing thickness cracks and running cracks which may be caused when a blade penetrates an engine casing. The engine containment apparatus includes a plurality of layers which are each formed from a plurality of alternating orientations of sheets formed from fibers. The first layer facilitates increasing an axial stiffness of the engine casing, such that thickness cracks which may run circumferentially around an outer periphery of the engine casing are facilitated to be reduced. The second layer facilitates increasing a radial or hoop stiffness to the engine casing, such that a field stress induced to the engine casing during a blade impact event is facilitated to be reduced. The third layer facilitates increasing a torsional and axial stiffness of the engine case, such that relatively large circumferential cracks in the engine casing which may occur after the blade impact event while the turbine is wind-milling are also facilitated to be reduced. Accordingly, an engine containment system is provided which facilitates reducing the potential adverse effects of a blade impact event and of foreign object damage in a cost-effective and reliable manner.

Exemplary embodiments of containment assemblies are described above in detail. The containment assemblies are not limited to the specific embodiments described herein, but rather, components of each assembly may be utilized independently and separately from other components described herein. For example, each containment system component can also be used in combination with other containment system components, with other gas turbine engines, and with non-gas turbine engines.

While the invention has been described in terms of various specific embodiments, those skilled in the art will recognize that the invention can be practiced with modification within the spirit and scope of the claims.

What is claimed is:

1. A method for fabricating a gas turbine engine, said method comprising:

coupling an engine casing circumferentially around a gas turbine engine; and coupling an engine containment wrap to the gas turbine engine, such that the containment wrap circumscribes at least a portion of the gas turbine engine casing, wherein the containment wrap includes a plurality of layers coupled together such that a first layer is formed from at least three sheets coupled together such that a first sheet is formed from a plurality of fibers that are oriented substantially in a first direction, a second sheet is formed from a plurality of fibers oriented in a second direction that is offset approximately forty-five degrees from the first sheet, and such that a third sheet is formed from a plurality of fibers that are oriented substantially parallel to the first direction, and wherein the plurality of first sheet fibers are aligned substantially axially with the respect to the gas turbine engine.

2. A method in accordance with claim 1 wherein coupling an engine containment wrap to the gas turbine engine further comprises coupling a fourth sheet to the third sheet such that a plurality of fibers within the fourth sheet are oriented in a direction that is offset approximately ninety degrees from the orientation of the fibers within the second sheet.

3. A method in accordance with claim 1 wherein coupling an engine containment wrap to the gas turbine engine further comprises coupling the engine containment wrap to the engine such the first layer that is fabricated from a fiberglass material.

4. A method in accordance with claim 1 wherein coupling an engine containment wrap to the gas turbine engine further comprises coupling the engine containment wrap to the gas turbine engine such that one layer formed is at least approximately 0.09 inches thick.

5. A method in accordance with claim 1 wherein coupling an engine containment wrap to the gas turbine engine further comprises coupling a second layer to the first layer, wherein the second layer is formed from at least three sheets coupled together such that a first sheet within the second layer includes a plurality of fibers that are oriented substantially in a direction that is substantially perpendicular to the orientation of the fibers within the first layer first sheet, and such that a second sheet within the second layer includes a plurality of fibers that are oriented in a second direction that is offset approximately forty-five degrees from the second layer first sheet.

6. A method in accordance with claim 1 wherein coupling an engine containment wrap to the gas turbine engine further comprises coupling the engine containment wrap to the gas turbine engine that includes a second layer that is fabricated from a graphite material.

7. A method in accordance with claim 1 wherein coupling an engine containment wrap to the gas turbine engine further comprises coupling a second layer to the first layer such that the second layer formed is approximately 0.085 inches thick.

8. A method in accordance with claim 7 wherein coupling an engine containment wrap to the gas turbine engine further comprises coupling the engine containment wrap to the engine that includes a third layer that is formed from a glass epoxy material.

9. A method in accordance with claim 7 wherein coupling the engine containment wrap to the gas turbine engine further comprises coupling the third layer to the second layer such that the third layer formed is at least approximately 0.09 inches thick.

10. A containment apparatus for a gas turbine engine including an engine casing, said containment apparatus comprising a first layer comprising a plurality of sheets that each comprise a plurality of fibers, a first of said plurality of sheets coupled to the gas turbine engine casing such that said first sheet circumscribes at least a portion of the casing and such that said first sheet plurality of fibers are aligned substantially axially with respect to said gas turbine engine, a second of said plurality of sheets coupled to said first sheet such that said second sheet plurality of fibers are aligned approximately forty-five degrees offset from said first sheet plurality of fibers, a third of said plurality of sheets coupled to said second sheet such that said third sheet plurality of fibers are aligned substantially parallel to said first sheet plurality of fibers.

11. A containment apparatus in accordance with claim 10 wherein said first layer further comprises a fourth sheet coupled to said third sheet such that said fourth sheet plurality of fibers are aligned approximately ninety degrees offset from said second sheet plurality of fibers.

12. A containment apparatus in accordance with claim 10 wherein said first layer comprises a fiberglass material.

13. A containment apparatus in accordance with claim 10 wherein one layer is approximately 0.09 inches thick.

14. A containment apparatus in accordance with claim 10 further comprising a second layer comprising a plurality of sheets that each comprise a plurality of fibers, said second layer plurality of sheets comprising at least a first sheet and a second sheet, said second layer first sheet coupled against said first layer, such that said second layer first sheet circumscribes at least a portion of said gas turbine engine and such that said second layer first sheet plurality of fibers are aligned substantially perpendicular to the engine axial direction, said second layer second sheet coupled to said second layer first sheet such that said second layer second sheet plurality of fibers are aligned approximately forty-five degrees offset from second layer first sheet plurality of fibers.

15. A containment apparatus in accordance with claim 14 wherein said second layer comprises a graphite material.

16. A containment apparatus in accordance with claim 14 wherein said second layer is approximately 0.085 inches thick.

* * * * *

UNITED STATES PATENT AND TRADEMARK OFFICE

CERTIFICATE OF CORRECTION

PATENT NO. : 7,018,168 B2
APPLICATION NO. : 10/820491
DATED : March 28, 2006
INVENTOR(S) : Worthoff et al.

It is certified that error appears in the above-identified patent and that said Letters Patent is hereby corrected as shown below:

In Claim 3, column 6, line 55, delete "engine such the first layer that is" and insert therefor -- engine such that the first layer is--.

Signed and Sealed this

Eighteenth Day of September, 2007

JON W. DUDAS
*Director of the United States Patent and Trademark Office*